US006637843B2

(12) United States Patent
Westwinkel

(10) Patent No.: US 6,637,843 B2
(45) Date of Patent: Oct. 28, 2003

(54) MODULAR HOUSING

(75) Inventor: Florian Westwinkel, Toronto (CA)

(73) Assignee: Wesko Locks Ltd., Mississauga (CA)

( * ) Notice: Subject to any disclaimer, the term of this patent is extended or adjusted under 35 U.S.C. 154(b) by 48 days.

(21) Appl. No.: 09/969,151

(22) Filed: Oct. 3, 2001

(65) Prior Publication Data

US 2003/0062810 A1 Apr. 3, 2003

(51) Int. Cl.[7] ..... E05L 7/06
(52) U.S. Cl. ..... 312/221; 312/218
(58) Field of Search ..... 312/216, 217, 312/218, 221, 222, 215, 305, 107.5

(56) References Cited

U.S. PATENT DOCUMENTS

| | | | | | |
|---|---|---|---|---|---|
| 2,582,766 | A | * | 1/1952 | Burggrabe | 221/9 |
| 4,221,440 | A | * | 9/1980 | Morgan | 312/9.45 |
| 4,298,236 | A | | 11/1981 | Laroche | |
| 4,355,851 | A | | 10/1982 | Slusser | |
| 4,429,930 | A | | 2/1984 | Blouin | |
| 4,936,640 | A | | 6/1990 | Pratzer | |
| 4,993,784 | A | * | 2/1991 | Dana et al. | 312/221 |
| 5,056,877 | A | | 10/1991 | Westwinkel | |
| 5,062,678 | A | | 11/1991 | Westwinkel | |
| 5,176,436 | A | | 1/1993 | Mitchell | |
| 5,199,774 | A | | 4/1993 | Hedinger et al. | |
| 5,352,030 | A | | 10/1994 | Derle et al. | |
| 5,427,445 | A | | 6/1995 | Mitchell | |
| 5,567,027 | A | | 10/1996 | McClung et al. | |
| 5,599,078 | A | | 2/1997 | Dechene et al. | |
| 5,782,545 | A | * | 7/1998 | Kahara et al. | 312/217 |

FOREIGN PATENT DOCUMENTS

| | | |
|---|---|---|
| CA | 1114883 | 12/1981 |
| CA | 2034107 | 11/1991 |
| CA | 2034585 | 7/1992 |
| CA | 2037194 | 8/1992 |
| CA | 1307022 | 9/1992 |

OTHER PUBLICATIONS

Atropex Inc. Drawings date marked between 1981 and 1991 (4 sheets).

* cited by examiner

*Primary Examiner*—Janet M. Wilkens
(74) *Attorney, Agent, or Firm*—Arent Fox Kintner Plotkin & Kahn

(57) ABSTRACT

A modular housing assembly is stacked in a vertical array of similar assemblies within a multi-drawer storage unit. A modular housing assembly includes a housing and a linear channel extending though opposite ends of the housing. The channel opens into the interior of the housing. Two bar end modules slide along the channel. The end modules may be connected to bar spacers cut from separate pieces to form assembled sliding bars. An actuator, including a fork and a cam, is provided to lock the sliding bars to prevent more than one drawer from opening at one time. The actuator rotates within the housing, about a pin mounted between two walls of the housing. A modular housing and a kit for installing a modular housing assembly are also described.

24 Claims, 8 Drawing Sheets

FIG. 5
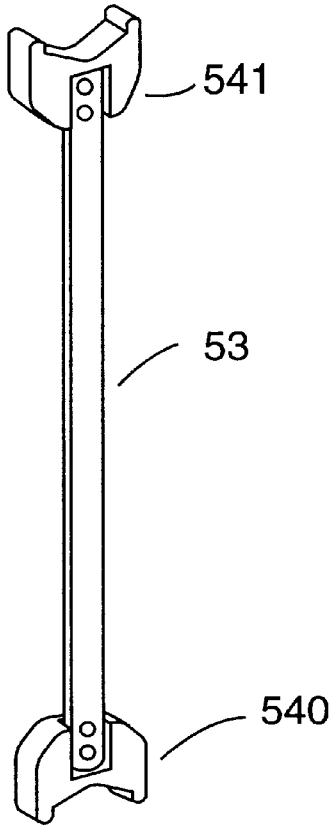
FIG. 5A
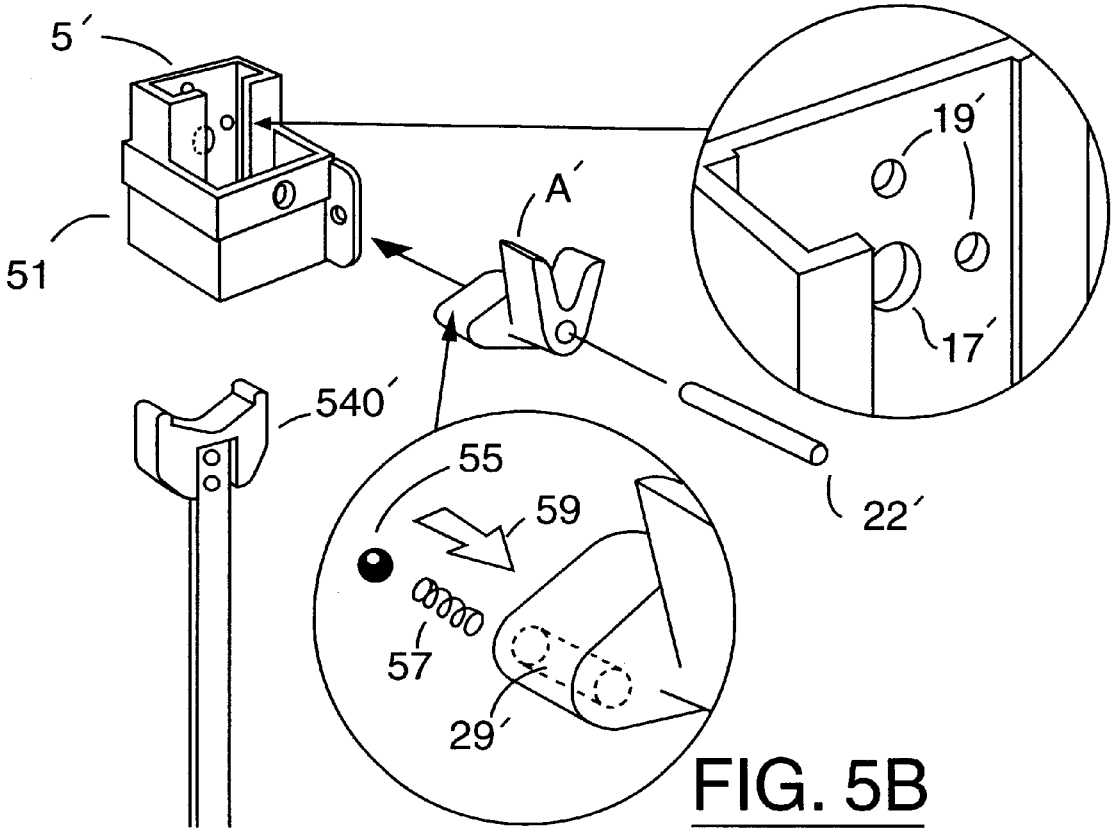
FIG. 5B 875
83

8B
81
853
827
8A
80
88
84
853'

89
85
99
80'

MODULAR HOUSING

FIELD OF THE INVENTION

The invention relates to a modular connective housing for use in association with anti-tip systems and locking mechanisms in storage compartments, furniture, cabinets, and the like. The invention also provides a kit for installing a modular housing and related components in an anti-tip system or locking mechanism.

BACKGROUND OF THE INVENTION

Storage units included in office furniture, cabinets and many other items are provided with retractable storage compartments. The storage compartments, usually in the form of drawers, are often mounted on slides. If multiple drawers or storage compartments are withdrawn from the storage unit so that two or more drawers are extended at one time, there is risk that the storage unit will topple over. Whenever there is a risk of upset, there is a possibility of damage to personal property or injury to the operator or passersby.

Various anti-tip systems have been developed to inhibit the withdrawal of multiple drawers at one time. In those earlier systems, manufacturers, installers, and service personnel often encounter difficulties in sorting, combining, installing and then securing the various components in the intended arrangement necessary to provide a functional unit. Often the system components are difficult to install and align because certain elements are incorrectly sized or missing.

Consequently, there is a need for an improved housing to simplify installation and alignment of the components in anti-tip systems and in multiple compartment locking systems. There is also a need for a kit or combination of locking or anti-tip systems components, including an improved housing, that may be easily assembled, combined and installed in a multiple compartment storage unit.

SUMMARY OF THE INVENTION

In one aspect, the invention comprises a modular housing for use in a multiple storage compartment unit. The storage unit may be a desk, filing cabinet, or other unit having multiple drawers stacked in a linear array. The housing may be used in connection with an anti-tip system, a locking system or a combined anti-tip and locking system. It will be understood that in some embodiments, the anti-tip system may not be strictly necessary to prevent tipping or upset of a particular storage unit. For example, some multiple storage compartment type units may be installed as fixtures. The units may be secured to a floor, wall or other immovable structural member. In those instances, the assembly system will be useful to inhibit withdrawal of more than one drawer compartment at a time.

The modular housing is secured to a stationary part of the storage unit, preferably an inner wall of the unit, in close proximity to a corresponding drawer. Each drawer is provided with a corresponding pair of opposing sliding bars, a housing and an actuating member operatively associated with the drawer. Each housing comprises a channel for receiving the ends of the corresponding two opposing sliding bars. The sliding bars are stacked in a linear array along one side of the corresponding drawer. The ends of the bars slide within the channel when the actuating member is triggered upon withdrawal of the corresponding drawer. The actuating member is secured to the housing, relative to the channel so that the actuating member will operatively separate or engage the ends of the sliding bars upon withdrawal of the drawer. The housing is configured to receive the ends of the sliding bars in aligned, sliding arrangement. The housing is also configured to receive the actuating member in a pre-aligned position, allowing the actuating member to operate between two positions. When the actuator is in its first position, any one of the drawers in an array may be opened, including the drawer associated with the particular actuating member. When the actuator is in its second position, the ends of the corresponding pair of slides are engaged (or separated relative to each other), by the operatively associated actuator, upon withdrawal of the corresponding drawer. All other sliding bars within the aligned array are displaced to inhibit their corresponding drawers from opening.

When any one drawer within the linear array of drawers in the storage unit is withdrawn to its open position, the corresponding pair of opposing sliding bars are engaged by the operatively associated actuating member, and all of the other pairs of sliding bars are prevented from separating (or being further displaced) in a manner that would allow withdrawal of a second or other drawer from the storage unit. When the opened drawer is returned to its closed position within the storage unit, the corresponding actuating member is repositioned so that the corresponding sliding bars are no longer displaced.

In a preferred embodiment, the actuating member comprises a cam which rotates between two positions. The cam is positioned within the housing, in an intermediate position within the channel so that the ends of the opposing pair of sliding bars will engage each other, without engaging the opposing surfaces of the cam. When the cam is in the first rotating position, the corresponding drawer (or any other drawer within the linearly aligned array) may be opened. If the cam is rotated to its second rotating position, the corresponding pair of opposing sliding bars are engaged by the bearing surfaces of the cam upon withdrawal of the corresponding drawer. When another drawer within the linear array (i.e., a drawer other than the associated drawer) is withdrawn from the storage unit, the cam remains in its first rotation position, but the associated pair of bars are translated to a displaced position. When the sliding bars are in this displaced position, one of the sliding bars engages one of the surfaces of the corresponding cam, thus preventing opening of the corresponding drawer. Displacement of the other sliding bars within the array (other than the pair of bars associated with the opened drawer) is also prevented in a corresponding manner. That is, one of the ends of the other sliding bar pairs engages a surface of its corresponding cam, to prevent opening of the associated drawer.

In another embodiment, the actuating member (comprising the cam) is configured to operate between three positions. The actuating member comprises a cam which rotates between two positions and slides between one of the first two positions and a third position. The cam is positioned within the housing, in an intermediate position within the channel so that the ends of the opposing pair of sliding bars will engage the opposing bearing surfaces of the cam. When the cam is in the first rotating position (and first sliding position), the corresponding drawer (or any other drawer within the linearly aligned array) may be opened. If the cam is rotated to its second rotating position (while the cam is still in the first sliding position) the corresponding pair of opposing sliding bars are separated relative to each other upon withdrawal of the corresponding drawer. When another drawer within the linear array (i.e., a drawer other than the associated drawer) is withdrawn from the storage unit, the cam remains in its first rotation position, but is translated to a third position (which also corresponds to the second sliding position of the cam.) When the actuator is in the third position, the ends of the corresponding pair of sliding bars are displaced by translation, but not separated, upon withdrawal of a non associated drawer. When the actuator is in the third position, the ends of the corresponding pair of opposing sliding bars cannot be separated (the cam cannot rotate) and the associated drawer cannot be withdrawn from the storage unit.

In another aspect, the invention includes a storage unit having two or more storage compartments, such as for example, sliding drawers. The storage unit comprises a modular housing with a channel opening at opposite ends of the housing. The housing may be secured to the wall or other structural member of a storage unit. The ends of two opposing sliding bars are received within opposite ends of the channel. Slide bar segments, which may be cut or otherwise fashioned to be of a desired length, are secured to the bar ends to provide completed sliding bars. An actuation member is mounted adjacent to the two sliding bars in a location that allows the actuation member to operatively associate opening of one drawer with the locking of the sliding bars. An axial mounting member, for example a pin, bolt, screw or other fastener, secures the actuating member to the housing in the predetermined position. The combined housing, actuation member, sliding bars, and mounting member form an assembly unit associated with one sliding drawer. The assembly unit is stacked in a linear array of similar abutting assemblies, each of which is associated with one drawer within a multiple drawer storage unit. In the fully assembled storage unit, the completed linear array of assembly units is provided with stops to limit the extent to which the sliding bars may be displaced along the linear array path. In a preferred embodiment, the actuation member includes a cam positioned between two opposing sliding bar ends. The bar ends are connecting modules that are secured to the ends of the intermediate bar spacer segments. The connecting modules define bearing surfaces that engage the cam during operation of the drawers within the assembled unit. The configuration of the cam, the configuration of the bearing surfaces in the abutting connecting modules and the predetermined displacement allowance defined by the stops are interrelated so as to limit the storage unit to the opening of one drawer at one time.

In another aspect, the invention includes a kit for installing a modular housing assembly within a storage unit. The kit includes a housing with an integral channel, actuation member, sliding bar ends, slide bar spacer segments that may be cut or otherwise adapted to a desired length, and a mounting member to secure the actuation member to the housing. The kit may also include fasteners to secure the modular housing assembly to the storage unit.

In another aspect, the invention includes a storage unit in which there have been installed two or more of the modular housing assemblies.

The features of the present invention, including further embodiments of the invention, will become apparent upon consideration of the following detailed description including the appended drawings of a preferred embodiment of a modular housing.

IN THE DRAWINGS

A preferred embodiment of the present invention is represented in the following drawings.

FIG. 5 is an exploded view, in perspective, of a modular assembly unit.

FIG. 5A is an enlarged view of a portion of a modular housing component included in the assembly shown in FIG. 5.

FIG. 5B is an enlarged view of a portion of a cam portion of an actuator component included in the assembly shown in FIG. 5.

DETAILED DESCRIPTION

Figure 1:
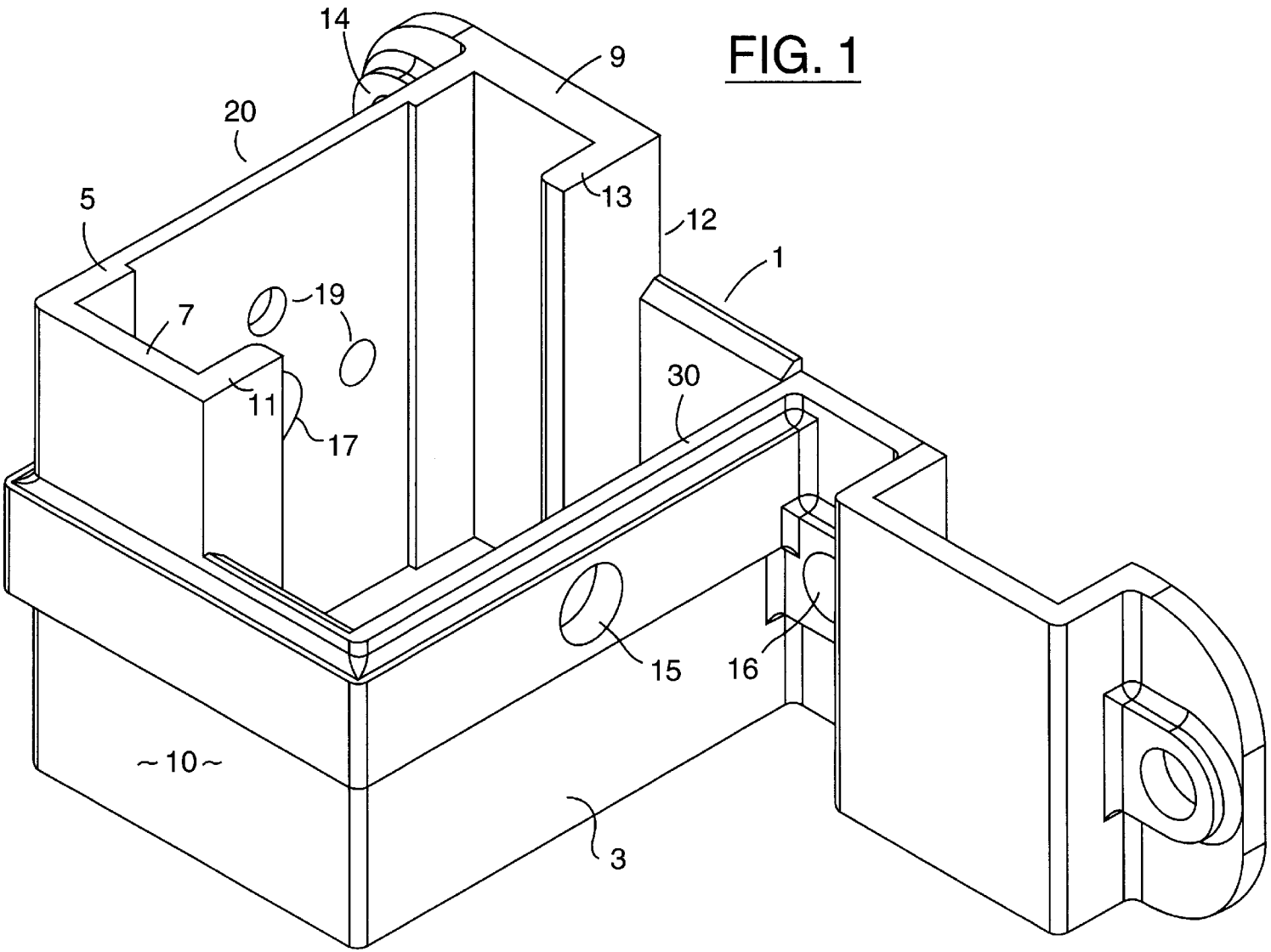
FIG. 1 is a frontal view, in perspective, of one embodiment of the modular housing.
Figure 2:
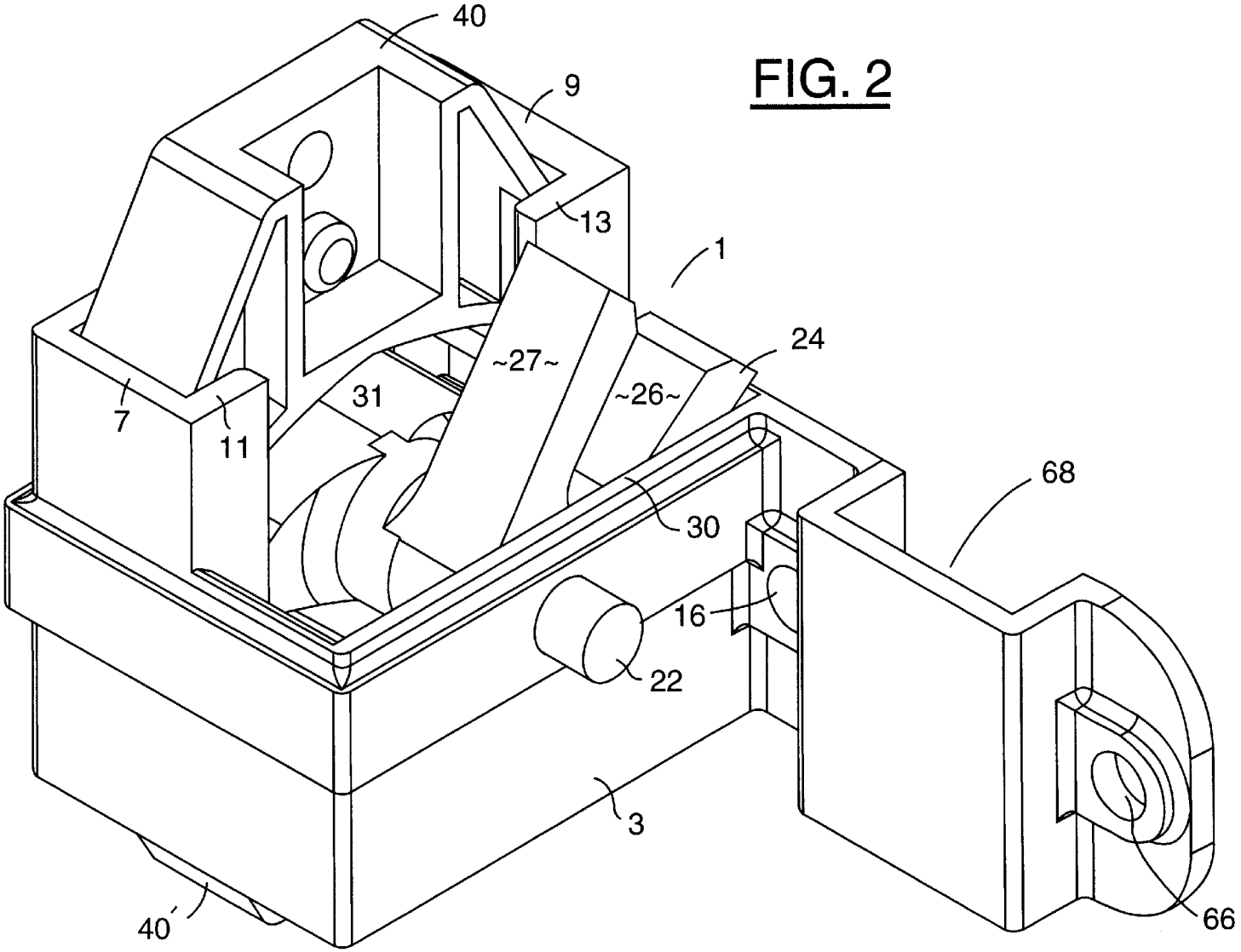
FIG. 2 is a frontal view, in perspective, of the embodiment of the modular housing shown in FIG. 1, in partial assembly with selected components of a preferred anti-tip mechanism.

A preferred embodiment of the present invention is illustrated in FIGS. 1 to 4 of the appended drawings. With reference to FIGS. 1 and 2, a modular housing 1 defines an inner channel 5 bounded by outer wall 20, opposing channel side walls 7, 9 and abutments 11, 13. The channel 5 opens into the interior chamber of the housing. The housing is also bounded by front wall 10, rear wall 12 and a second side wall 3. Apertures 15, 17 are provided in opposing side walls 3, 20 to receive a pin, bolt or other suitable element 22 to support the actuator assembly within the housing 1. The actuator assembly (shown in FIG. 4) comprises an actuating fork 27 and a cam 31. The actuator assembly is supported so that it may rotate within the housing. Upper edge 30 of wall 3 is recessed. The actuating fork 27 projects above the upper edge 30 so that the fork may be operatively actuated upon withdrawal of the corresponding drawer. The recessed edge 30 allows a projection (or other element) associated with the corresponding drawer to activate the fork upon withdrawal or closure of the drawer.

Mounting flanges 14, 16 are provided to securely fasten the housing to a wall of a filing cabinet or other storage unit (not shown). Detent recesses 19 may be provided to define preferred operating positions for the rotatable actuator.

When installed, opposing connecting modules 40, 40' are positioned within the channel 5, on opposite sides of the cam element 31.

FIGS. 1 and 2 show an optional locking bar channel segment 68 with an additional, optional flange 66. In a simplified housing, the channel segment 68 and flange 66 would be omitted. However, in the illustrated embodiment, channel segment 68 defines a track to guide a second linear array of locking bars in a storage unit requiring added security features. The channel 68 may be used as a track for a locking bar included in a stacked linear array of locking bars. For example, the stacked linear array of locking bars may be secured when all of the drawers are fully retracted and in the closed position. However, it is to be understood that this second channel is merely an optional feature that may be utilized in appropriate circumstances and will be omitted from many embodiments of the invention where this feature is not required.

Figure 3:
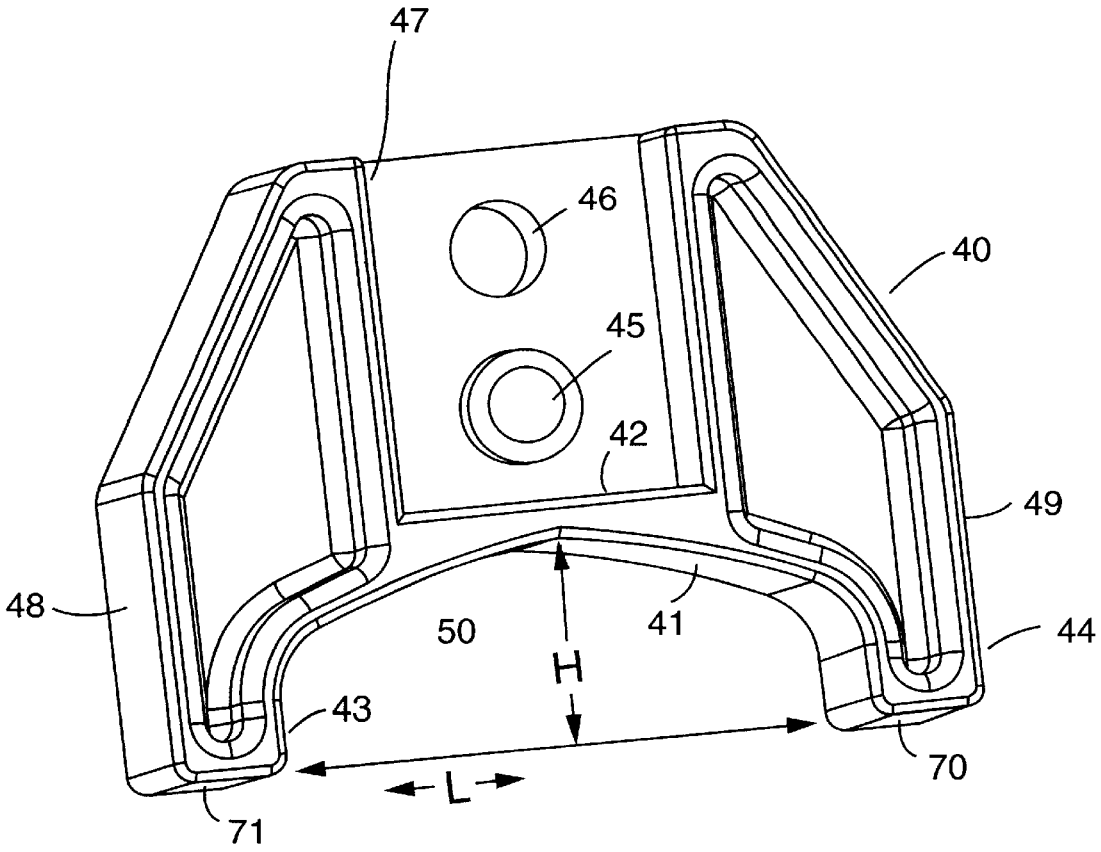
FIG. 3 is a frontal view, in perspective, of the connecting module included in partial assembly of FIG. 2.

FIG. 3 shows upper bar connecting module 40 in isolation. The connecting module includes projecting arms 43, 44 with corresponding outer bearing surfaces 48, 49. When installed within the housing, the bearing surfaces 48, 49 will slide along the side walls 7, 9 of the channel 5. The bar connecting module 40 defines a channel 47 with a terminal end 42. A rigid bar spacer segment (not shown) of predetermined length is securely fastened to the connecting module for installation within the desired storage unit. A projection 45 is provided to engage a corresponding aperture in the bar spacer segment (not shown). Similarly, an opening 46 may be provided in the module 40, to receive a pin, rivet or other fastener to further secure the bar spacer segment to the module. In other embodiments, the sliding bar assemblies may be modified so that stackable bar spacer segments will removably engage with corresponding connecting modules. It may be desirable to permit quick separation of the bar segments from the connecting modules without having to remove fasteners or the like. That is, in some instances the components of the sliding bar assemblies, when installed, may float in stacked relation to the actuating assembly.

The rigid bar spacers may be made of any suitably rigid material, depending on the requirements of the particular installation. The bar spacers may be made in pre-selected lengths for use in association with stacking arrays spanning various distances. In other embodiments, the bars may be pre-notched or pre-formed to permit an installer to snap off or cut away excess length in the bar, to customize the overall length of the installed bar and assembly. It will be appreciated that the connecting modules may be made of one material and the rigid bar segments may be made in another material. By providing discreet connecting modules, it is possible to mold, form, cast or otherwise manufacture the modules separately from the bar segments. Accordingly, the use of separate bar connecting modules and bar segments will provide advantages (including flexibility) in the manufacture, assembly and installation of those components for use in the anti-tip and locking assemblies.

The connecting module 40 defines terminal edges 70, 71 of corresponding arms 44, 43. When upper module 40 is installed in housing 1 along with lower module 40', terminal edges 70, 71 will normally abut against the corresponding terminal edges of lower module 40'.

The connecting module 40 also defines a bearing surface 41. The bearing surface 41 defines the upper edge of a cam receiving recess 50. The cam receiving recess 50 is defined by a maximum height H and a maximum spanning length L.

Figure 4:
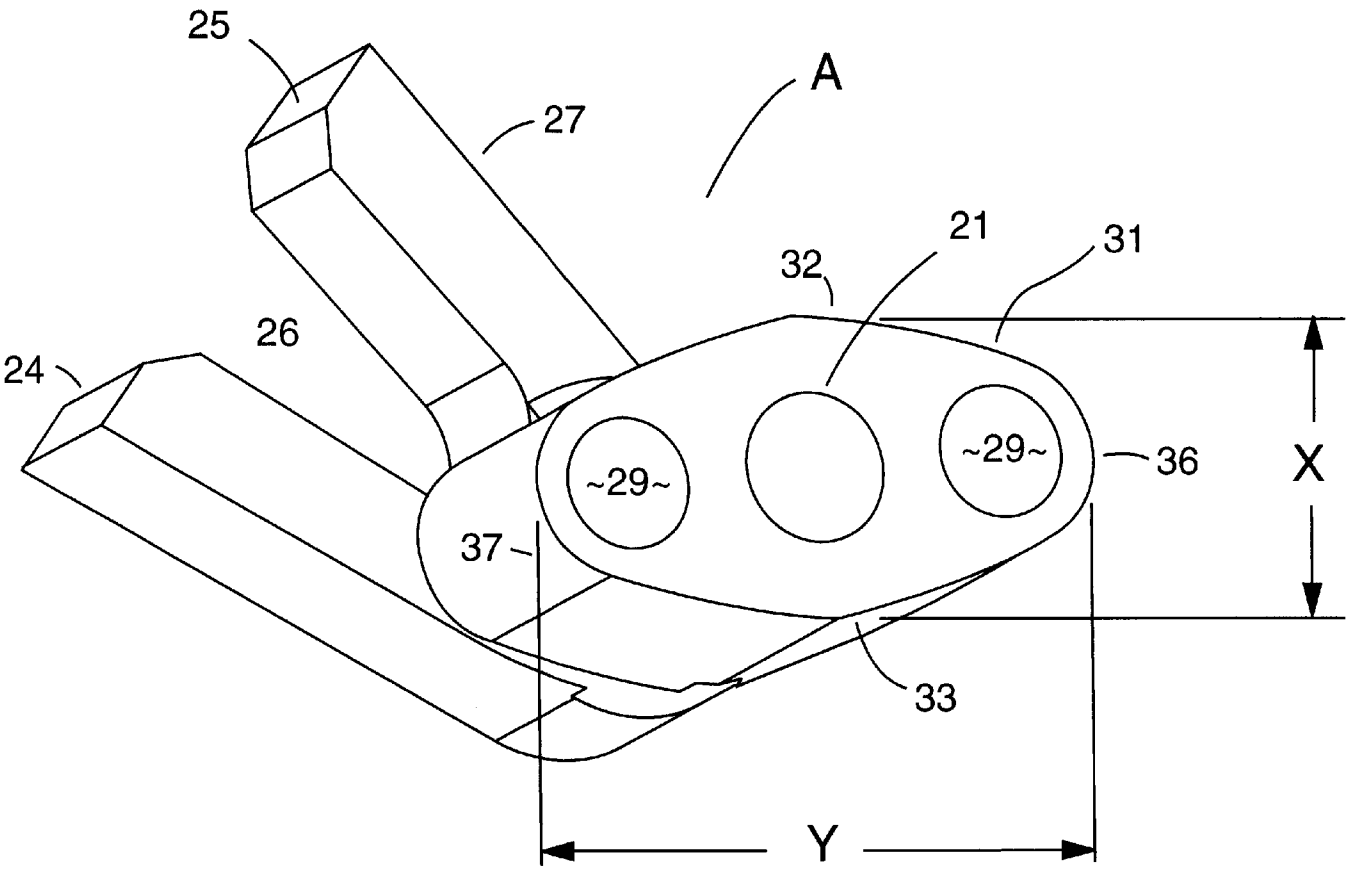
FIG. 4 is a rear view, in perspective, of the actuator included in the partial assembly of FIG. 2.

With reference to FIG. 4, the actuating assembly A is shown with an actuating fork 27 secured to a cam 31. The actuating assembly is shown, in rear view, relative to its assembled position as shown in FIG. 2. The fork 27 is provided with engagement extensions 24, 25 which in turn define an intermediate engagement channel 26. When installed in the completed assembly, the fork is positioned so that it will engage with a projection or other feature (not shown) on a drawer or drawer slide, when the drawer is withdrawn or returned to its enclosed position. The pin 22 is received in the aperture 21 which extends through the cam and the fork. When the fork is engaged and displaced, by rotation about its axis (defined by pin 22) the cam 31 is similarly rotated about that axis.

Cam 31 defines upper edge 32 and opposing lower edge 33. Cam ends 36, 37 define bearing surfaces that will engage bearing surfaces 41 of upper connecting module 40 and a corresponding bearing surface (not shown) in lower connecting module 40' when the drawer corresponding to this assembly is withdrawn from its storage unit. A pair of recesses 29 are shown as optional ports to receive spring loaded pins, or other detent features to bias the actuator assembly into one or two preferred positions (preferably corresponding to a fully opened and a fully closed position). Optional detent recesses 19 may also be provided on the modular housing as illustrated in FIG. 1.

The cam 31 is defined by its maximum height X and its maximum length Y. The cam length Y is preferably only slightly less than the length L of the cam receiving recess 50 to reduce undesirable movement of the cam within the recess. In this embodiment, the cam height X is about equal to the height H of the cam receiving recess. However, it will be understood that other proportions are possible in configuring the cams and cam receiving recesses of the connecting modules. In yet further variations of the invention, additional or alternative detents may be provided in complimentary features in the cam bearing surfaces and the bearing surfaces of the rod connecting modules. By way of example, FIGS. 3 and 4 illustrate complimentary features in surfaces 32 and 41. Cam bearing surface 32 is provided with a modest peak or ridge which compliments and snugly fits within the modest trough or depression formed within bearing surface 41 of connecting module 40. Thus, when the upper surface 32 of cam 31 contacts bearing surface 41 of connecting module 40, the cam is biased to remain in that position. Similarly, when the cam is rotated toward the (drawer) open position, the cam end 37 is biased toward positioning within the ridge or trough formed at the peak of the recess on bearing surface 41.

In the preferred embodiment in which the complete assembly is installed within a storage unit, rotation of a cam in one modular housing assembly will cause the cam ends 36, 37 to engage the bearing surfaces 41 of adjacent connecting modules. Upon engagement of that one pair of connecting modules, one of the modules in each pair of the other adjoining modules within the linear array will engage a corresponding cam within their modular housing. That engagement between the other cams and one of their corresponding modules in the remaining pairs of modules, will prevent withdrawal of the other drawers.

When a corresponding drawer is closed, the cam ends 36, 37 will be at rest, in their normal position, adjacent to the terminal edges 70, 71 of projecting arms 44, 43. The distance between opposing bearing surfaces 41 of upper and lower connecting modules 40, 40' is sufficient to permit the abutting pair of connecting modules to move upwardly or downwardly within the channel 5 when another drawer is opened within the array. When the corresponding drawer is opened, the cam ends will be rotated to engage the bearing surfaces 41 of the opposing and abutting adjacent connecting modules 40, 40'.

FIG. 5 illustrates a partial exploded view of a modular assembly unit comprising an upper bar assembly 53 having an upper connecting module 541 and lower connecting module 540. A lower bar assembly includes an upper connecting module 540'. Complimentary opposing connecting modules 540, 540' are received within opposing ends of channel 5' defined by the modular housing 51. Connecting modules 540, 540' are adapted to slide within the channel 5'. The actuator assembly A' is received within the housing 51 and is mounted in the housing for rotation about pin 22'. The pin 22' is secured to the housing so that the actuator assembly may rotate about the axis defined by the pin, with the cam portion of the assembly A', positioned between connecting modules 540 and 540'. It will be appreciated that an axial element other than a pin may be used.

FIG. 5A is an enlarged partial view of the modular housing 51 shown in FIG. 5. The enlarged view shows an aperture 17' provided to receive one end of the mounting pin 22' and two detent recesses 19'. The detent recesses are provided to compliment and interact with two corresponding detent members mounted on the cam portion of the actuator assembly. In FIG. 5B, an enlarged partial view is shown of the cam portion of the actuator assembly A' illustrated in FIG. 5. In FIG. 5B, a bore 29' is provided within one end of the cam portion of the actuator assembly A'. A spring 57 and corresponding detent ball 55 are loaded into the bore 29' along the direction illustrated by arrow 59. It will be understood that the ball is biased outwardly from the bore, so that the ball will preferentially seat itself within a corresponding detent recess 19' upon rotation of the actuator (and cam) to a predetermined preferred position.

Figure 6:
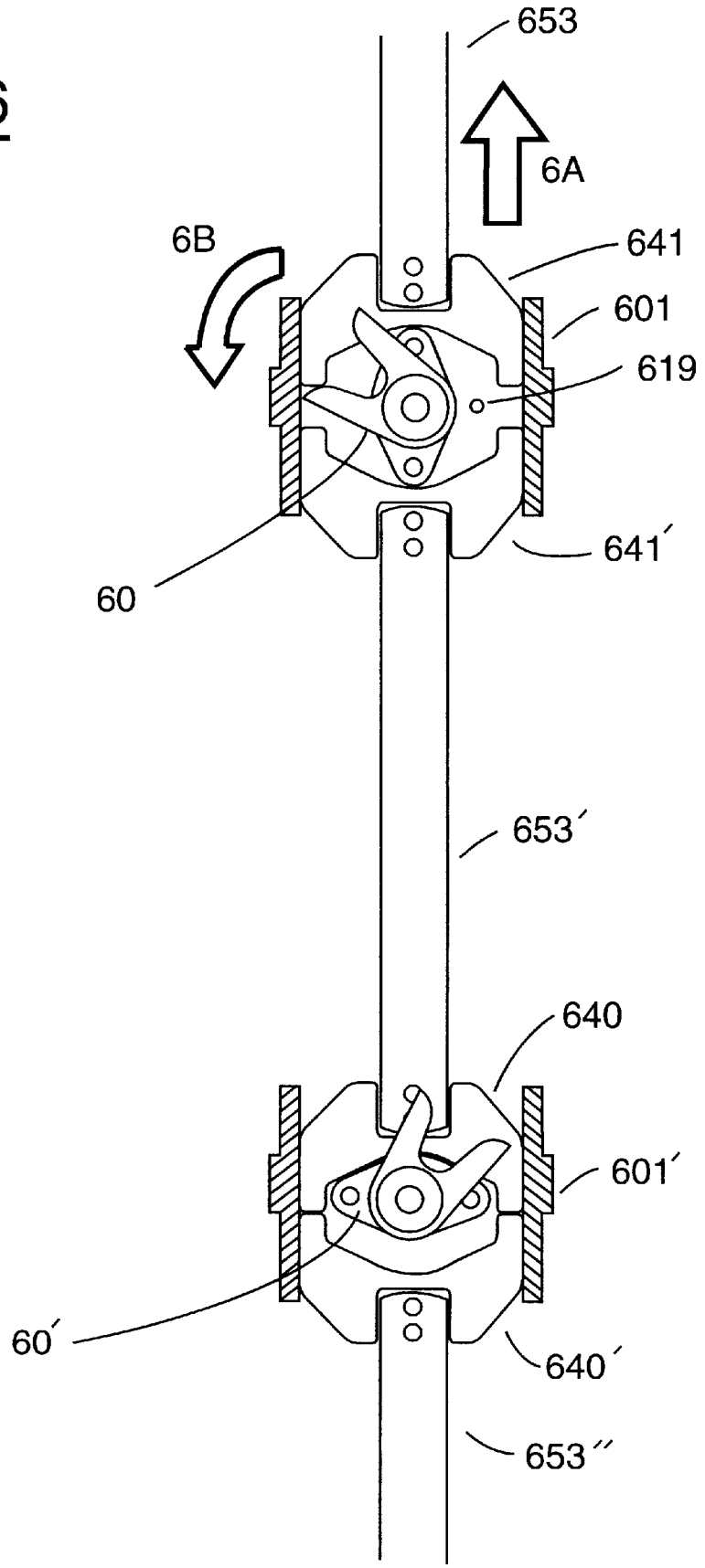
FIG. 6 is a side view, in partial section, of a vertical array of two adjacent modular assembly units.

FIG. 6 illustrates a partial sectional view of two adjacent, mounted modular assembly units. An upper modular assembly unit includes an upper bar assembly 653 and a second, adjacent bar assembly 653' received within the channel defined by modular housing 601 (shown in sectional view). In particular, connecting modules 641, 641' are snugly positioned within the channel and are permitted to slide within that channel under appropriate operating conditions.

Similarly, connecting modules 640 and 640' of the lower modular assembly unit are allowed to slide within the channel defined by the lower modular housing 601' under appropriate operating conditions. The lower modular assembly unit also comprises the lowermost bar assembly 653", in which the latter bar assembly includes the connecting module 640'.

In the operating conditions illustrated in FIG. 6, the upper modular assembly is in a 'drawer open position' in which the corresponding sliding drawer has been withdrawn from the storage cabinet (not shown). Upon withdrawal of the drawer, the actuator assembly 60 was rotated (by engagement with a draw pin or other element mounted on the drawer) in a counterclockwise direction as illustrated by arrow 6*b*. Upon rotation of the actuator assembly, the cam component of the actuator assembly engages bearing surfaces of the upper and lower connecting modules 641, 641' causing upward displacement of the upper bar assembly 653 and locking the intermediate bar assembly 653' against displacement. In turn, when intermediate bar assembly 653' is locked against displacement, connecting module 640 bears against the cam of the lower actuator assembly 60', thus preventing rotation of the lower actuator assembly 60' and accidental opening of the corresponding drawer.

FIG. 6 also shows detent recess 619 exposed after rotation of the cam portion of upper actuator assembly 60 from a 'drawer closed' position. Upon return of the actuator to the drawer closed position, the detent member in the cam portion (not shown) will again engage with the detent recess 619, to align the actuator to that corresponding, preferred position.

Figures 7, 7A:
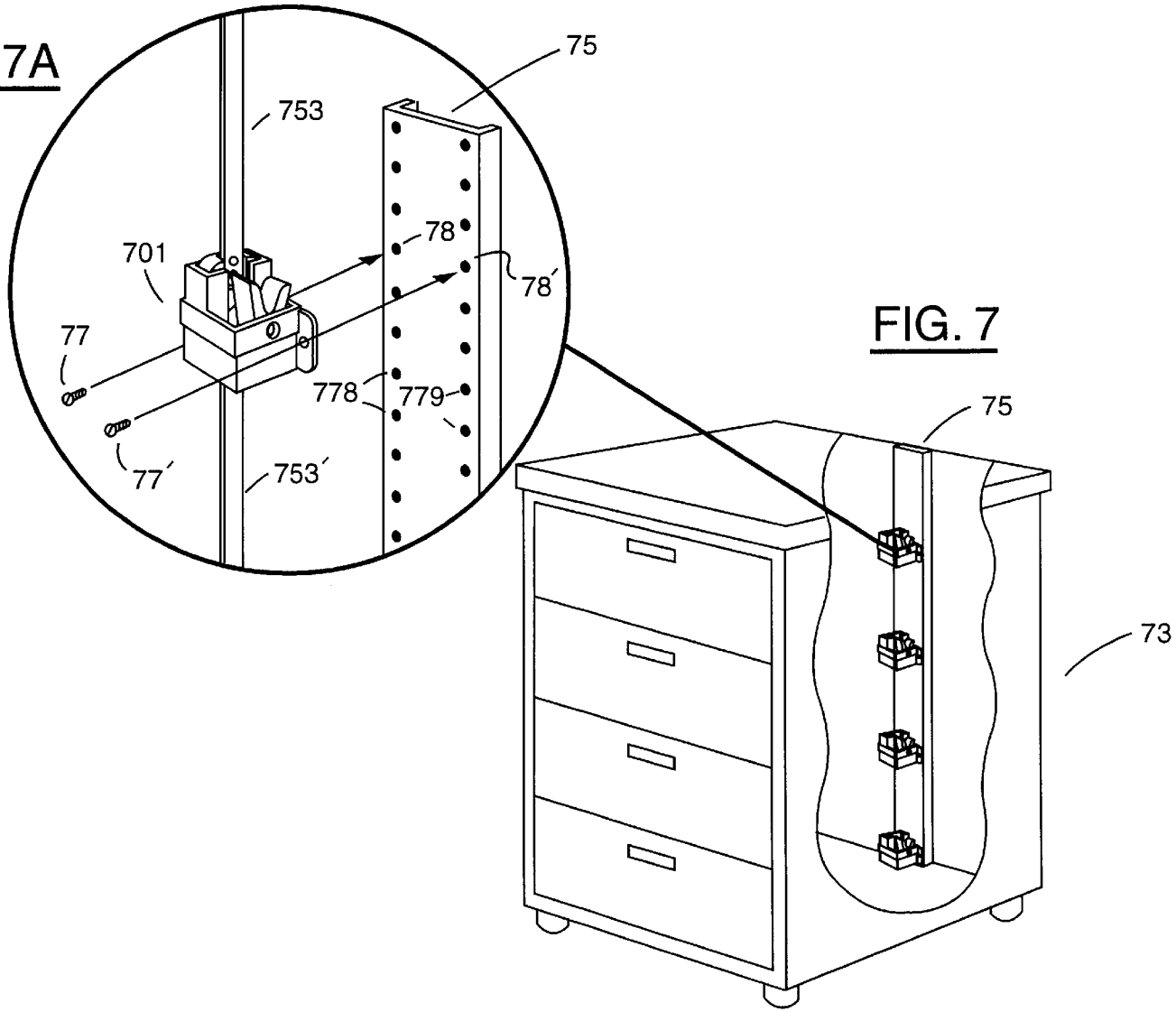
FIG. 7 is a perspective front view, in partial section, of a storage cabinet, including a vertical array of modular assembly units secured to a rear wall of the cabinet.
FIG. 7A is an enlarged view of a portion of a modular assembly unit shown in FIG. 7.

FIG. 7 shows a partial sectional view of a vertical array of modular assembly units mounted on the rear wall of a storage cabinet 73. In other embodiments, it may be more advantageous to mount the modular assemblies on a side wall or a front wall of a cabinet. An optional mounting track 75 is provided. The track 75 is secured to the back wall of the storage cabinet. The modular housings are, in turn, secured to the mounting track 75. FIG. 7A is an enlarged partial exploded view of one of the modular assemblies positioned adjacent a section of the mounting track 75. The optional mounting track 75 is provided with two vertical rows of pre-formed mounting apertures 778, 779. The mounting apertures 778, 779 are preferably spaced apart according to a predetermined distance. For example, it may be desirable to vertically space apart the mounting apertures in ¼ inch (or other measured) increments selected to accommodate differences in vertical heights in various installations. Provided the increments are properly selected, a standard mounting track may be adapted and used for different storage cabinets having varied vertical spatial requirements. The track may be manufactured in predetermined lengths, or in oversized lengths which may be cut to meet particular installation requirements.

In FIG. 7A, modular housing 701 is secured to the mounting track 75 by threaded screws 77, 77' received by corresponding preformed openings 78, 78'. Upper and lower bar assemblies 753, 753' are shown seated within the channel defined by housing 701. In the process of assembling and installing the components of the modular assemblies, it will often be preferable to first select the appropriate mounting position of a first modular assembly along the mounting track and then secure the first housing to the mounting track. The second and subsequent housings will often be secured to the mounting track in sequential order. Often the installer will install the first housing assembly (comprising an actuator assembly), and then insert the upper bar assembly within the first housing. The actuator in the first housing will be placed into its 'drawer open' position so that the next housing assembly may be positioned along the track at an appropriate separation distance away from the first housing assembly. The actuator of the next (and each subsequent) housing assembly will be positioned in its 'drawer closed' position so that the lengths of the remaining bar assemblies may be used to quickly and efficiently vertically position each next housing assembly, in sequential order, along the mounting track.

Of course, it will also be understood that the mounting distances between housing assemblies will also be influenced by the vertical dimensions of the drawers in the storage unit. The installer will select or be provided with the bar assemblies of appropriate length to meet the spatial requirements of the particular storage unit.

Figures 8, 8A, 8B:
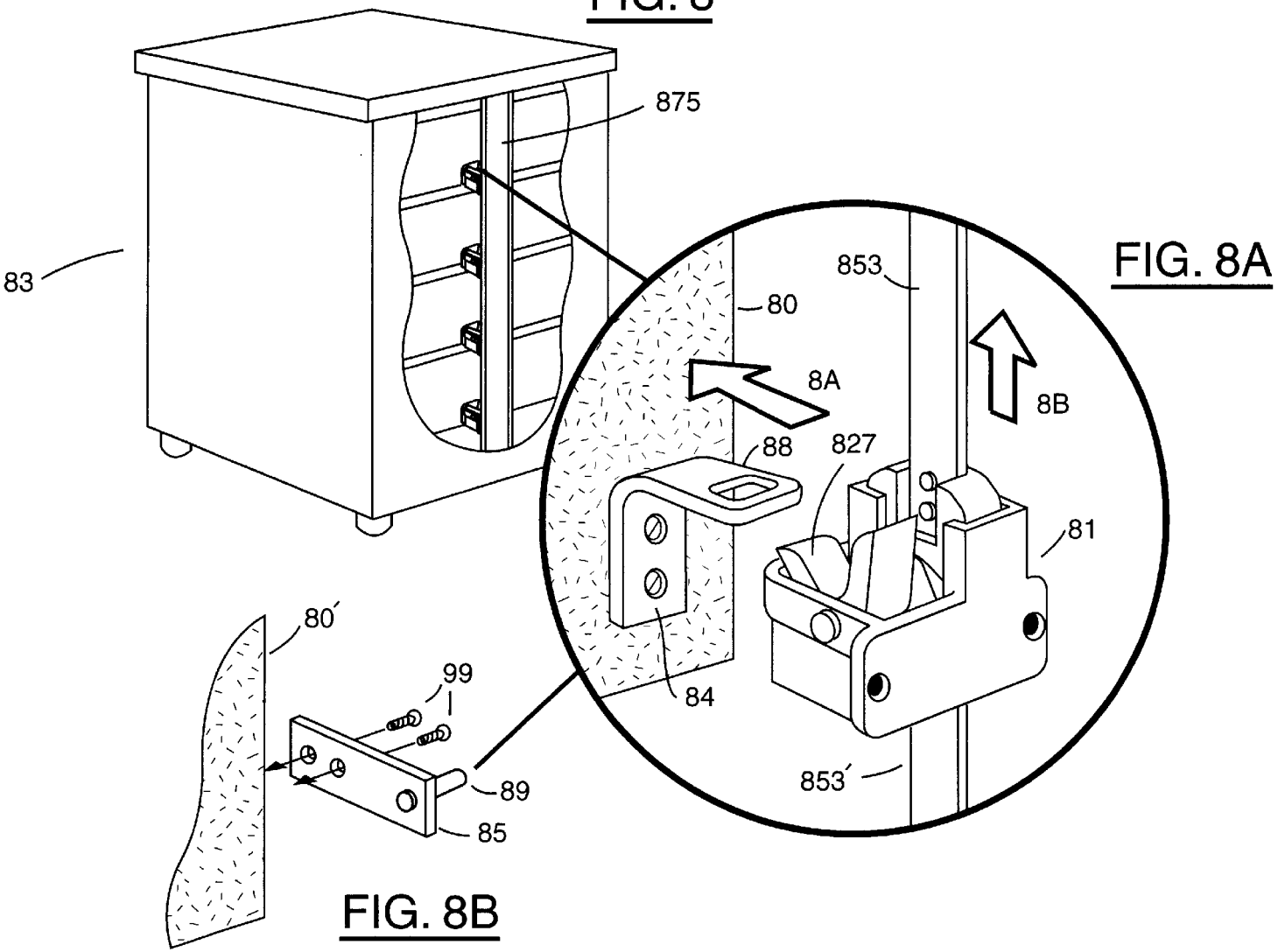
FIG. 8 is a perspective rear view, in partial section, of the storage cabinet shown in FIG. 7.
FIG. 8A is an enlarged partial view of a modular assembly unit positioned adjacent a corresponding drawer shown in FIG. 8.
FIG. 8B is an enlarged partial side view of an embodiment of a draw pin mountable on a side wall of a drawer shown in FIG. 8.

FIG. 8 shows a rear view of a storage cabinet 83, in partial section. An optional mounting track 875 is secured to the back wall of the cabinet. A vertical array of housing assemblies is secured to the mounting track 875. FIG. 8A is an enlarged view of one of the housing assemblies within the vertical array shown in FIG. 8. With reference to FIG. 8A, a draw bracket 84 is fastened to the rear wall of a drawer 80. The draw bracket 84 defines an opening 88 which receives fork 827 of the actuator when the drawer is moved to the drawer closed position. The draw bracket engages the fork 827 upon closing, so that the actuator will rotate in the clockwise direction.

In the operation illustrated in FIG. 8A, the drawer was opened by pulling the drawer 80 in the direction of arrow 8*a*. The actuator is rotated in a counterclockwise direction by pulling on the fork 827 with draw bracket 84, until the fork 827 is fully withdrawn from opening 88 and the draw bracket 84 is disengaged from the fork 827. Upon rotation of the actuator in the counterclockwise direction, the cam (not shown) bears on the ends of the bar assemblies 853, 853', pushes the upper bar assembly 853 in the direction of arrow 8*b,* and locks other bars in the vertical array against opening.

FIG. 8B shows an enlarged partial view of an alternative embodiment of a draw element, namely a draw pin 89 and support bracket 85 mounted on the side of a drawer 80'. The embodiment shown in this drawing may be used in a cabinet where the vertical array of housing assemblies is secured to a side wall of the cabinet. Support bracket 85 is secured to the side wall of drawer 80' by a pair of screws 99. Draw pin 89 is positioned so that it projects outwardly to engage the forks of a suitably positioned, corresponding actuator assembly in a modular housing secured to the side wall of the cabinet.

In another embodiment, which is not shown in the drawings, the actuating member (comprising the cam) is configured to operate between three positions. The actuating member comprises a cam which rotates between two positions and slides between one of the first two positions and a third position. The cam is positioned within the housing, in an intermediate position within the channel so that the ends of the opposing pair of sliding bars will engage the opposing bearing surfaces of the cam. When the cam is in the first rotating position (and first sliding position), the corresponding drawer (or any other drawer within the linearly aligned array) may be opened. If the cam is rotated to its second rotating position (while the cam is still in the first sliding position) the corresponding pair of opposing sliding bars are separated relative to each other upon withdrawal of the corresponding drawer. When another drawer within the linear array (i.e., a drawer other than the associated drawer) is withdrawn from the storage unit, the cam remains in its first rotation position, but is translated to a third position (which also corresponds to the second sliding position of the cam.) When the actuator is in the third position, the ends of the corresponding pair of sliding bars are displaced by translation, but are not separated, upon withdrawal of a non associated drawer. When the actuator is in the third position, the ends of the corresponding pair of opposing sliding bars cannot be separated (the cam cannot rotate) and the associated drawer cannot be withdrawn from the storage unit.

By way of example, in this other embodiment, a housing virtually identical to the housing 1 may provided. In this alternative embodiment, a pair of vertical, elongated parallel slots 15', 17' are substituted for circular apertures 15, 17. The slots 15', 17 receive the pin 22 which is used to rotatably secure the actuator assembly within the housing. The terminal ends of the slots define the maximum vertical travel of the actuating member.

In this embodiment, the height H of the corresponding recesses (in the bar ends) is shortened relative to the recesses 50 illustrated in the description relating to the preferred embodiment. Accordingly, when a corresponding drawer is opened, the cam ends 36, 37 will bear on the inner surfaces 41 of upper and lower connecting modules 40, 40' to separate the modules relative to each other. Opposing pairs of connecting modules positioned above the separated pair of adjacent modules will be displaced upwardly until the modules are stopped by the upper terminal ends of their associated slots 15', 17'. Connecting modules positioned below the separated pair of adjacent modules will be (translated) displaced downwardly until the displaced modules are stopped by the lower terminal ends of their associated slots 15', 17'. When the actuator is at rest in its normal position (with all drawers closed), the pin is located approximately in the middle of the corresponding slots 15', 17'. When the actuator is rotated, upon withdrawal of the corresponding drawer, the pin (and the related actuator) remain in the same relative vertical position when the drawer is in the open position. The connecting modules positioned above and below the separated pair of abutting modules, are displaced vertically (translated) along their respective slots 15', 17'. Within the assembled vertical array of sliding bars, modules, modular housings and actuating members, the stacked array of sliding bars are provided with stops or abutments to limit the maximum extent of vertical displacement of the bars within the array. That is, the stops or abutments are positioned so that only one pair of opposing connecting modules may be separated and only one drawer will be allowed to withdraw from the storage unit. Biasing elements (by way of example, springs) may be provided to return the sliding bars to their at rest position when all of the drawers are closed.

It will be apparent to those skilled in the art that various embodiments of the invention will provide a range of advantages and benefits, including some or all of the following. The housing may be made of a relatively inexpensive cast or molded material having desirable physical properties. For example, the housing may be cast or molded to include an integral channel to receive the sliding bar ends. By casting or molding an integral channel into the housing, manufacturing and assembly steps may be simplified and often the associated costs will be reduced. For example, by providing an integral channel, it will not be necessary to provide an additional discrete channel or track piece to guide the sliding bars. In earlier systems, many manufactures would often invest significant time and resources into manufacturing and stockpiling tracks made of expensive materials, such as rolled steel. Manufacturers and suppliers were often required to keep substantial inventories of various track types to accommodate differences in length and sizes of sliding bars.

The housing is configured so that the actuating member may be correctly positioned relative to the channel and relative to the sliding bar ends that will be received within the channel. A pin or other simple axial member may be used to mount the actuating member in its proper, pre-aligned position relative to the integral channel. For example, a smooth pin may be inserted through the pre-formed holes in the housing and through the bore within the actuating member. The pin may then be secured to the housing with an appropriate fastener.

Installation is simplified by incorporating the predetermined positions of the channel and actuating member within the completed assembly. Furthermore, the inserted sliding bars within the assembly will form a guide for installation of the neighboring assemblies within the linear array of assemblies. The exposed sliding bar ends of an installed assembly may be used as guides to properly position neighboring assemblies during installation. For example, the sliding bar end of an installed assembly may be inserted into the channel of a neighboring housing before that neighboring housing is secured to the storage unit.

It will also be appreciated that the modular construction of the sliding bar ends may be used to provide a wider range of options in the manufacture of the assembled sliding bar pieces. By way of example, the sliding bar ends may be made of a material that differs in its physical, strength and cost characteristics from those of the intermediate bar spacer segments. For example, the intermediate spacer segments may be stamped, cut or otherwise formed from a relatively low cost, rigid material with other characteristics which may make that material unsuitable for the bearing surfaces defined by the sliding bar ends. The sliding bar ends may be made from another material, which may be more compatible with the characteristics of the cam. For example, the cam and sliding bar ends may be made from like materials to avoid undesirable properties such as premature wear, susceptibility to heat or other problems.

The embodiments described in this specification are merely illustrative and are not intended to limit the invention to the specific features, elements or steps as described herein. Further and other modifications and variations will be apparent to those skilled in the art, thus making it possible to practice the other embodiments of the invention, all of which are within the spirit and scope of the present invention.

I claim:

1. A housing assembly for use in a multi-compartment storage unit, the storage unit comprising a plurality of stacked sliding drawers, wherein each of the sliding drawers is slidably mounted for withdrawal from the storage unit, and the storage unit comprises a plurality of like housing assemblies in an abutting linear array, the plurality of like housing assemblies comprising a plurality of sliding bar assemblies within the linear array, and a stop limiting displacement of the sliding bar assemblies in the linear array to a predetermined distance, each like housing assembly being operatively associated with one of the sliding drawers, the housing assembly comprising:

a housing defining a linear channel extending along a first axis and opening at opposite ends of the housing; the housing comprising a first wall of the channel opposite a second wall of the housing positioned away from the channel;

a pair of the sliding bar assemblies in opposing relation, comprising sliding bar ends located within opposite ends of the channel;

an actuator operatively associated with one of the sliding drawers, the actuator being located intermediate the opposing sliding bar ends, the actuator operating between first and second positions, wherein in the first position, the actuator permits displacement of the sliding bar ends within the linear channel upon withdrawal of the associated drawer from the storage unit, and in the second position the actuator engages at least one of the opposing sliding bar ends to inhibit displacement of the sliding bar ends within the linear channel; and a mounting member securing the actuator to the housing in a predetermined operative location relative to the sliding bar ends, the mounting member being coaxially positioned along a second axis extending between the first and second walls.

2. The housing assembly in claim 1 wherein the second axis is perpendicular to the first axis, and the actuator rotates about the second axis, between the first and second positions.

3. In the housing assembly as claimed in claim 2, the pair of opposing sliding bar ends, when abutting, define an enclosed space bounded by a first bearing surface and a second bearing surface opposing the first bearing surface, and the actuator comprises a cam defining a first and second opposing longitudinal surface and a first and second transverse surface, the cam being centrally positioned within the enclosed space when the actuator is in the first position.

4. In the housing assembly as claimed in claim 3, the first and second transverse surfaces engaging the first and second bearing surfaces when the actuator is in the second position.

5. In the housing assembly as defined by claim 3, the housing defining an aperture for securing the mounting member to the housing.

6. In the housing assembly as defined by claim 5, the aperture defining an elongated slot having first and second distal ends; the mounting member is (centrally located along the slot when the actuator rotates between the first and second positions; and the mounting member is displaced to a position adjacent to one of the first and second distal ends of the elongated slot when the actuator is in a third position.

7. The housing assembly of claim 1 wherein the actuator operates between said first and second positions and a third position, wherein in the second position the actuator bears against both of the opposing sliding bar ends, and in the third position the actuator bears against at least one of the opposing slide bar ends upon withdrawal of an unassociated drawer, and the actuator returning to the first position upon closure of the unassociated drawer.

8. In the housing assembly as claimed in claim 7, at least one of a first longitudinal surface and a second longitudinal surface engaging at least one of a first bearing surface and a second bearing surface when the actuator is in the third position.

9. In the housing assembly as claimed in claim 8, the first and second longitudinal surfaces engaging the first and second bearing surfaces when the actuator is in the third position.

10. The housing assembly as claimed in claim 1, comprising a pair of bar spacers, one of the spacers being secured to a corresponding one of the sliding bar ends.

11. The housing as claimed in claim 10 wherein the bar spacers are made from a first material and the sliding bar ends are made from a second material differing from the first material.

12. A housing for use in a multi-compartment storage unit, the housing comprising:

a plurality of outer walls defining an inner chamber, a first wall being of a lower height relative to a second wall, the first wall defining a first aperture and the second wall defining a second aperture, for receiving an axial mounting member extending through the inner chamber between the first and second apertures;

the housing defining a linear channel extending through the inner chamber, the channel opening at opposite ends of the housing and defining a first axis;

the first and second apertures being positioned along a second axis, the second axis being perpendicular to the first axis; and at least one fastening element for securing the housing to the multi-compartment storage unit.

13. In the housing claimed in claim 12, the channel opening into the inner chamber.

14. In the housing claimed in claim 13, the second wall defining a wall of the linear channel, and the channel extending along a longitudinal axis defined by the second wall.

15. In the housing claimed in claim 14, the housing comprising spaced apart abutments projecting from two opposing walls of the housing, inwardly toward the chamber, the abutments extending along the channel.

16. The housing claimed in claim 15, comprising a second linear channel exterior of the chamber, the second channel being parallel to the first channel.

17. The housing claimed in claim 12, wherein the housing is made from a single work piece.

18. A kit comprising a pair of sliding bar assemblies, an actuator, a housing, and an axial mounting member, the housing comprising:

a plurality of outer walls defining an inner chamber, a first wall being of a lower height relative to a second wall, the first wall defining a first aperture and the second wall defining a second aperture, for receiving the axial mounting member extending through the inner chamber between the first and second apertures;

the housing defining a linear channel extending through the inner chamber, the channel opening at opposite ends of the housing and defining a first axis;

the first and second apertures being positioned along a second axis, the second axis being perpendicular to the first axis; and at least one fastening element for securing the housing to the multi-compartment storage unit.

19. The kit claimed in claim 18, wherein a first sliding bar end of a first sliding bar assembly is configured for sliding movement along a first end of the channel, a second sliding bar end of a second sliding bar assembly is configured for sliding movement along a second end of the channel, the sliding bar ends each defining an enclosed space when the sliding bars are abutting, the space enclosing a cam defined by the actuator.

20. The kit as claimed in claim 19, wherein the actuator comprises a fork defining an engagement channel extending along a first longitudinal axis, the first longitudinal axis being inclined to a second longitudinal axis defined by the cam.

21. The kit as claimed in claim 20, the fastening element comprising a mounting track defining a plurality of predefined positions for securing the housing relative to the mounting track.

22. The kit as claimed in claim 21, wherein in the housing, the channel extends along the second wall and the channel opens into the inner chamber.

23. The kit as claimed in claim 18 comprising a pair of bar spacers, each one of the spacers being configured for secure attachment to a corresponding one of the sliding bar ends.

24. The kit as claimed in claim 23 wherein the bar spacers are made from a first material and the sliding bar ends are made from a second material differing from the first material.

* * * * *